US009681512B1

(12) United States Patent
Xiong et al.

(10) Patent No.: US 9,681,512 B1
(45) Date of Patent: Jun. 13, 2017

(54) COMBINED WIRELESS VOLTAGE CONTROLLED DIMMING INTERFACE FOR AN LED DRIVER

(71) Applicant: Universal Lighting Technologies, Inc., Madison, AL (US)

(72) Inventors: Wei Xiong, Madison, AL (US); Keith Davis, Madison, AL (US); John J. Dernovsek, Madison, AL (US); Stephen D. Mays, II, Madison, AL (US)

(73) Assignee: UNIVERSAL LIGHTING TECHNOLOGIES, INC., Madison, AL (US)

( * ) Notice: Subject to any disclaimer, the term of this patent is extended or adjusted under 35 U.S.C. 154(b) by 0 days.

(21) Appl. No.: 15/287,941

(22) Filed: Oct. 7, 2016

Related U.S. Application Data

(60) Provisional application No. 62/238,440, filed on Oct. 7, 2015.

(51) Int. Cl.
*H05B 33/08* (2006.01)
*H05B 37/02* (2006.01)

(52) U.S. Cl.
CPC ..... *H05B 33/0845* (2013.01); *H05B 33/0815* (2013.01); *H05B 33/0887* (2013.01); *H05B 37/0272* (2013.01)

(58) Field of Classification Search
CPC .... H05B 37/02; H05B 33/08; H05B 33/0809; H05B 33/0815; H05B 33/0818; H05B 33/083; H05B 33/0842; H05B 33/0845; H05B 33/0854; H05B 33/0872; H05B 33/0887
USPC ..... 315/185 R, 209 R, 224–226, 291, 307, 315/308, 312
See application file for complete search history.

(56) References Cited

U.S. PATENT DOCUMENTS

2015/0054423 A1* 2/2015 Tyson ..... H05B 37/0272 315/291

* cited by examiner

*Primary Examiner* — Jimmy Vu
(74) *Attorney, Agent, or Firm* — Patterson Intellectual Property Law, P.C.; Mark J. Patterson; Grant M. Ford

(57) ABSTRACT

A control system for a light emitting diode (LED) driver is provided. The control system includes a control module, a command interface, and a combined signal interface. The control module includes a microcontroller configured to receive at least one signal and to determine an LED driver command signal and a command module connected to the microcontroller and capable of communicating with both the lighting dimmer and the wireless control module. The control system includes a command interface which communicatively couples the control module to the LED driver. A combined signal interface communicatively couples the command module and at least one of the lighting dimmer and the wireless control module. The combined signal interface conveys one or more signals between the control module and at least one of the lighting dimmer and the wireless control module. Associated methods and modules are also provided.

20 Claims, 7 Drawing Sheets

200

COMBINED WIRELESS VOLTAGE CONTROLLED DIMMING INTERFACE FOR AN LED DRIVER

CROSS-REFERENCES TO RELATED APPLICATIONS

This application claims priority to and benefit of U.S. Provisional Patent Application No. 62/238,440, dated Oct. 7, 2015, entitled "Combined Wireless Voltage Controlled Dimming Interface for an LED driver," and which is hereby incorporated by reference in its entirety.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to a combined wireless voltage controlled dimming interface for a light emitting diode (LED) driver. More particularly, the present invention relates to enabling a plurality of control devices to be communicatively coupled to a control module associated with an LED driver using a shared interface, the shared interface being configured to provide operating power to one or more control devices during operation.

LED lighting is growing in popularity due to decreasing costs and long life compared to incandescent lighting and fluorescent lighting. LED lighting can also be dimmed without impairing the useful life of the LED light source.

An exemplary configuration of an LED lighting system 10 including a dimmable LED driver 14 is represented in FIG. 1. As shown, a dimmable LED driver 14 is positioned between an AC power source V_AC_in 12 (e.g., an AC mains input) and an LED lighting module 16. The LED driver 14 is configured to regulate a DC current passing through the LED lighting module 16 and to receive control signals from a control module 18. The LED lighting module 16 is configured with a plurality of LEDs LED1, LED2, . . . LEDn that receive power from the LED driver 14.

FIG. 1 illustrates a communication control module 18 having separate interfaces for 0-10 volt dimming and wireless control modules in the related art. The dimmable LED driver 14 may be configured to operate according to a dimming control signal driver_ctl based on input received from a 0-10 volt dimmer 24 and wireless control module 26 as shown in FIG. 1. In the illustrated configuration, there are four control input lines: two control lines (corresponding to signals Ctl+ (e.g., via a purple+ wire) and Ctl− (e.g., via a grey− wire)) for 0-10 volt dimming control and two control lines (e.g., corresponding to signals W_Ctl+ and W_Ctl−) for the wireless control module 26. The wireless control module 26 may be configured to receive an external input signal, for example, using wireless communication protocols such as ZIGBEE® or BLUETOOTH®.

A DC voltage is provided from the control module 18 to a lighting dimmer, such as 0-10 volt dimmer 24, via Ctl+ and Ctl− signal lines. One or more of the Ctl+ and Ctl− signals may be received by a dimming and tuning circuit 22 of the control module 18 and processed at a microcontroller 20 of the control module 18. The microcontroller 20 is configured to transmit a control signal driver_ctl to the LED driver 14 during operation based upon signals received from the dimmer 24 or a wireless control module 26. The wireless control module 26 is configured to communicate one or more LED driver control signals to the control module 18 via W_Ctl+ and W_Ctl−. The control module 18 receives control signals from the dimmer 24 and the wireless control module 26 and determines and transmits a control signal driver_ctl for output to the LED driver 14.

While the dimmer 24 and wireless control module 26 may be separately interfaced with the control module 18, difficulties arise when device power requirements are not universal between disparate control devices and/or when a plurality of dimming and control signal sources are connected to the control module 18 via shared control lines. For example, systems having a plurality of dimming and control signal sources each having their own dedicated lines connected to the communication control circuit 18 results in a burdensome wiring configuration, multiple points of failure, and requires distinct power circuits and configurations.

One significant disadvantage of an implementation having an arrangement similar to that illustrated in FIG. 1 is that if the 0-10 volt dimmer 24 and wireless control module 26 share a common interface to the control module 18, the system is unable to provide the current required to operate the wireless control module 26. A dimming signal interface associated with the control module 18 may provide only a 250 μA constant current to the 0-10 volt dimmer 24 when the dimmer is connected to the interface. However, a wireless control module 26 may require more than 1 mA operating current when transmitting. This means that simply connecting the wireless control module 26 to an existing 0-10 volt dimmer 24 interface will not work.

BRIEF SUMMARY OF THE INVENTION

It is desirable to reduce the number of required control lines (e.g., from four separate control lines to two shared control lines) required to operate using both 0-10 dimming controllers and wireless controllers.

One object of the systems and methods disclosed herein is to provide a control system for a light emitting diode (LED) driver. The LED driver provides power to an LED lighting module in an LED lighting system that includes a lighting dimmer and a wireless control module. The control system includes a control module, a command interface, and a combined signal interface. The control module includes a microcontroller and a command module. The microcontroller is configured to receive at least one signal and to determine an LED driver command signal. The command module is coupled to the microcontroller and is capable of communicating with both the lighting dimmer and the wireless control module.

The control system includes a command interface which communicatively couples the control module to the LED driver. The control system also includes a combined signal interface which communicatively couples the command module and at least one of the lighting dimmer and the wireless control module. The combined signal interface conveys one or more signals between the control module and at least one of the lighting dimmer and the wireless control module. The one or more received signals may include at least one of a dimming control signal and a wireless control signal. The dimming control signal and the wireless control signal may be used, either alone or in combination, to control an output characteristic of the LED lighting system. For example, the output characteristic of the LED lighting system may include at least one of an on/off setting, a dimming setting, a color intensity setting, or other LED output setting associated with the LED lighting system. The microcontroller is configured to receive the one or more received signals, to process the one or more received signals to determine the LED driver command signal, and to transmit the LED driver command signal to the LED driver via the command interface.

Another aspect of the invention provided herein is a method of providing light emitting diode (LED) driver control by a control module of an LED lighting system, the LED lighting system including a dimming controller and a wireless control module. The method begins by providing a combined signal interface between the control module and at least one of the dimming controller and the wireless control module. The control module is configured to selectively disable dimming control associated with the dimming controller, and a sensing signal may be transmitted from the control module via the combined signal interface. It is determined whether a second controller is connected to the combined signal interface based at least in part upon whether a confirmation signal is received at the control module via the combined signal interface responsive to the transmitted sensing signal. Power is selectively provided to the second controller from the control module via the combined signal interface when it is determined that the second controller is connected to the combined signal interface.

In another aspect, a wireless control module for controlling output of a light emitting diode (LED) driver via a control module of an LED lighting system is provided. The wireless control module includes a communication module which communicatively couples the wireless control module to the control module via a combined signal interface. The wireless control module further includes a processor which receives an input signal from the control module via the combined signal interface and transmits an output signal to the control module via the combined signal interface. An input voltage detector is connected to the processor and to the combined signal interface. The input voltage detector being receives one or more signals via the combined signal interface. A switch is connected to the processor, the switch operating responsive to the processor to transmit an output signal via the combined signal interface based upon the one or more signals received by the input voltage detector.

Numerous other objects, features, and advantages of the present invention will be readily apparent to those skilled in the art upon a reading of the following disclosure when taken in conjunction with the accompanying drawings.

DETAILED DESCRIPTION OF THE INVENTION

Figure 1:
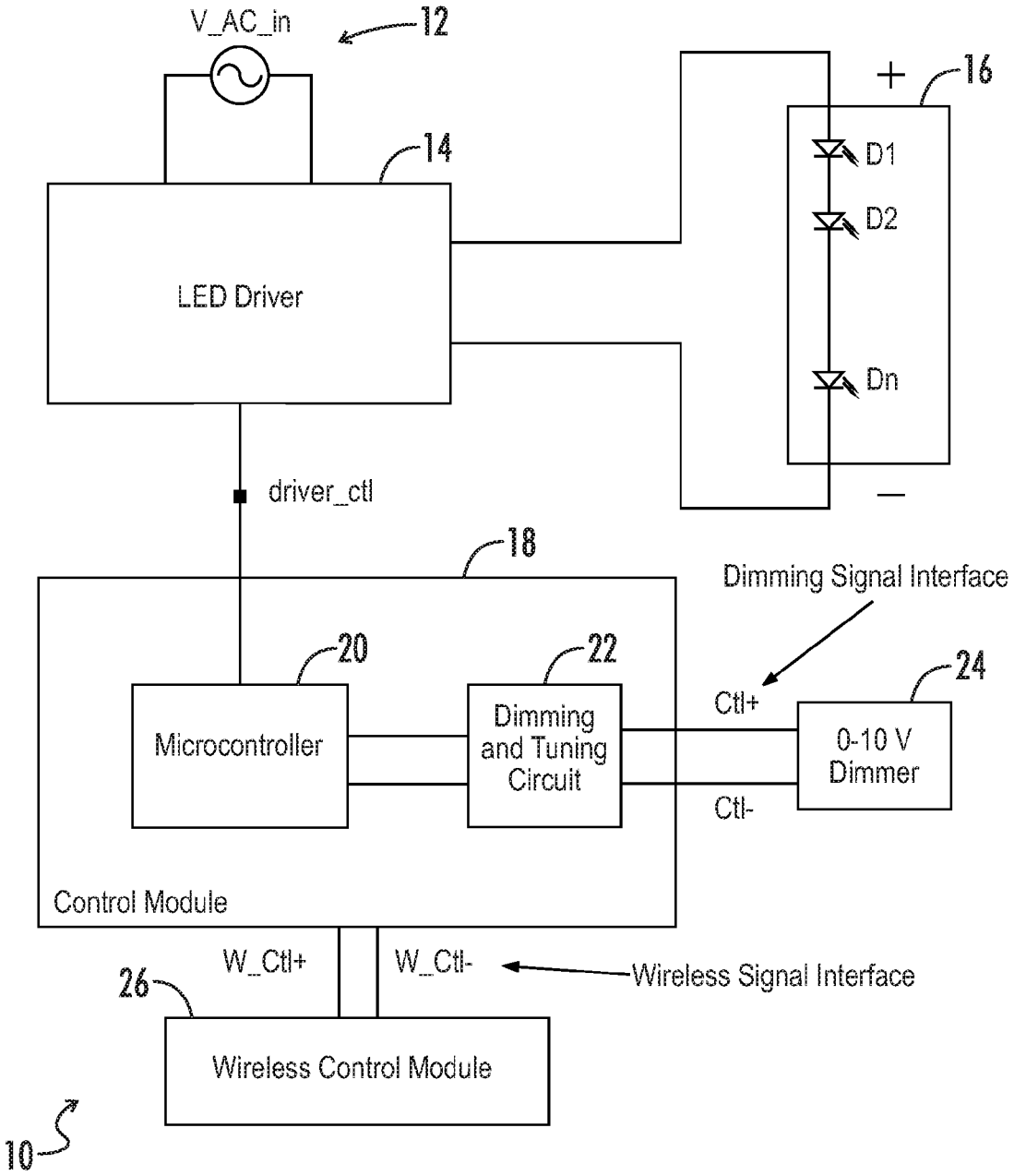
FIG. 1 Related Art
FIG. 1 illustrates a block diagram of a dimmable LED driver configuration in the related art.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

Referring generally to FIGS. 2-7, exemplary light emitting diode (LED) drivers, wireless control modules, and associated methods are now illustrated in greater detail. Where the various figures may describe embodiments sharing various common elements and features with other embodiments, similar elements and features are given the same reference numerals and redundant description thereof may be omitted below.

Various embodiments of an LED driver may be designed to provide a LED driver having a combined communications control interface using only two control lines (e.g., conductive lines). Embodiments of a wireless control module are further described to operate in conjunction with the LED driver to realize the combined signal interface. The LED driver and wireless control module, associated circuitry, and methods presented herein further address the objective of an improved communications interface while also providing operating power to at least one connected controller.

Figure 2:
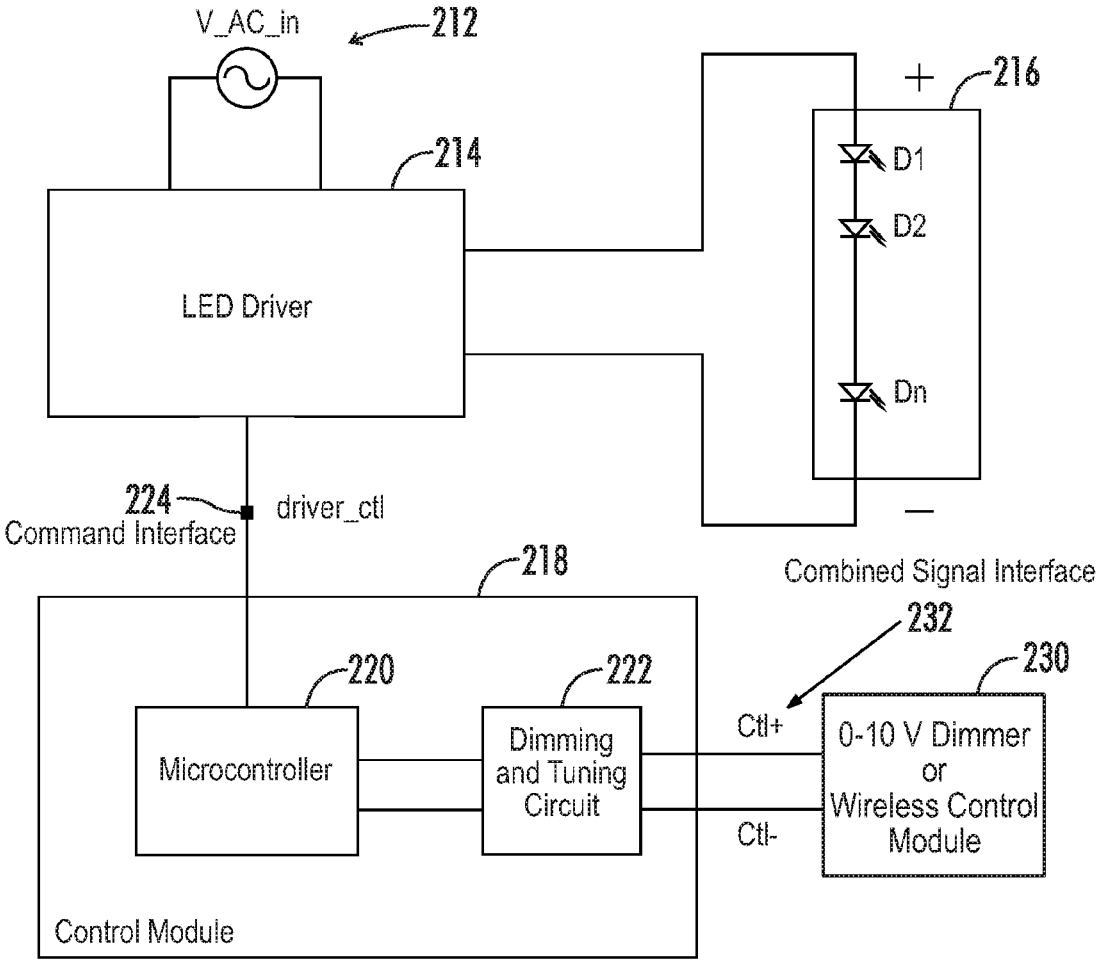
FIG. 2 illustrates a block diagram of an exemplary embodiment of a communication control circuit configuration having a combined communication interface according to the present invention.

FIG. 2 illustrates an exemplary embodiment of an LED lighting system 200 including an LED driver 214 having a combined dimming and control interface for at least one of a lighting dimmer and/or wireless control module (jointly illustrated in FIG. 2 as 0-10 V dimmer or wireless control module 230). The LED driver 214 is coupled between the AC power source V_AC_in 212 (e.g., an AC mains input) and both of an LED lighting module 216 and a control module 218. The control module 218 has a combined signal interface 232 across a plurality of control lines, configured to communicate signals via Ctl+ (e.g., along purple or purple+ wires) and via Ctl− (e.g., along grey or grey− wires), for providing both dimming control (e.g., via 0-10 volt dimming control) and wireless control. The LED driver 214 may be an adjustable AC-DC converter in one exemplary embodiment. The terms "power converter" and "converter" unless otherwise defined with respect to a particular element may be used interchangeably herein and with reference to at least DC-DC, DC-AC, AC-DC, buck, buck-boost, boost, half-bridge, full-bridge, H-bridge or various other forms of power conversion or inversion as known to one of skill in the art.

Control module 218 includes a microcontroller 220 and a dimming and tuning circuit 222. The microcontroller 220 may control the LED driver 214 by receiving a command signal from the 0-10 volt dimmer or wireless control module 230, processing the received command signal to determine a driver current control signal, and transmitting the driver current control signal to the LED Driver 214 via a microcontroller output of the microcontroller 220. The control module 218 may include a dimming control path connecting the dimming and tuning circuit 222 to the microcontroller 220, wherein one or more command signals received via the dimming control interface are provided to the microcontroller 220 via the dimming control path. One or more control signals (driver_ctl) may be transmitted to the LED driver 214 via the microcontroller output. In one exemplary embodiment, a control signal driver_ctl may be transmitted via a command interface 224 configured to communicatively couple the control module 218 and the LED driver 214. When a 0-10 volt dimming control and wireless control interface are combined together as illustrated in FIG. 2, difficulties arise in providing power supply to a wireless control module. Problems associated with implementing at least one of the combined 0-10 volt dimmer or wireless control module may be overcome in accordance with the features described below with reference to the exemplary embodiment of FIG. 3.

Figure 3:
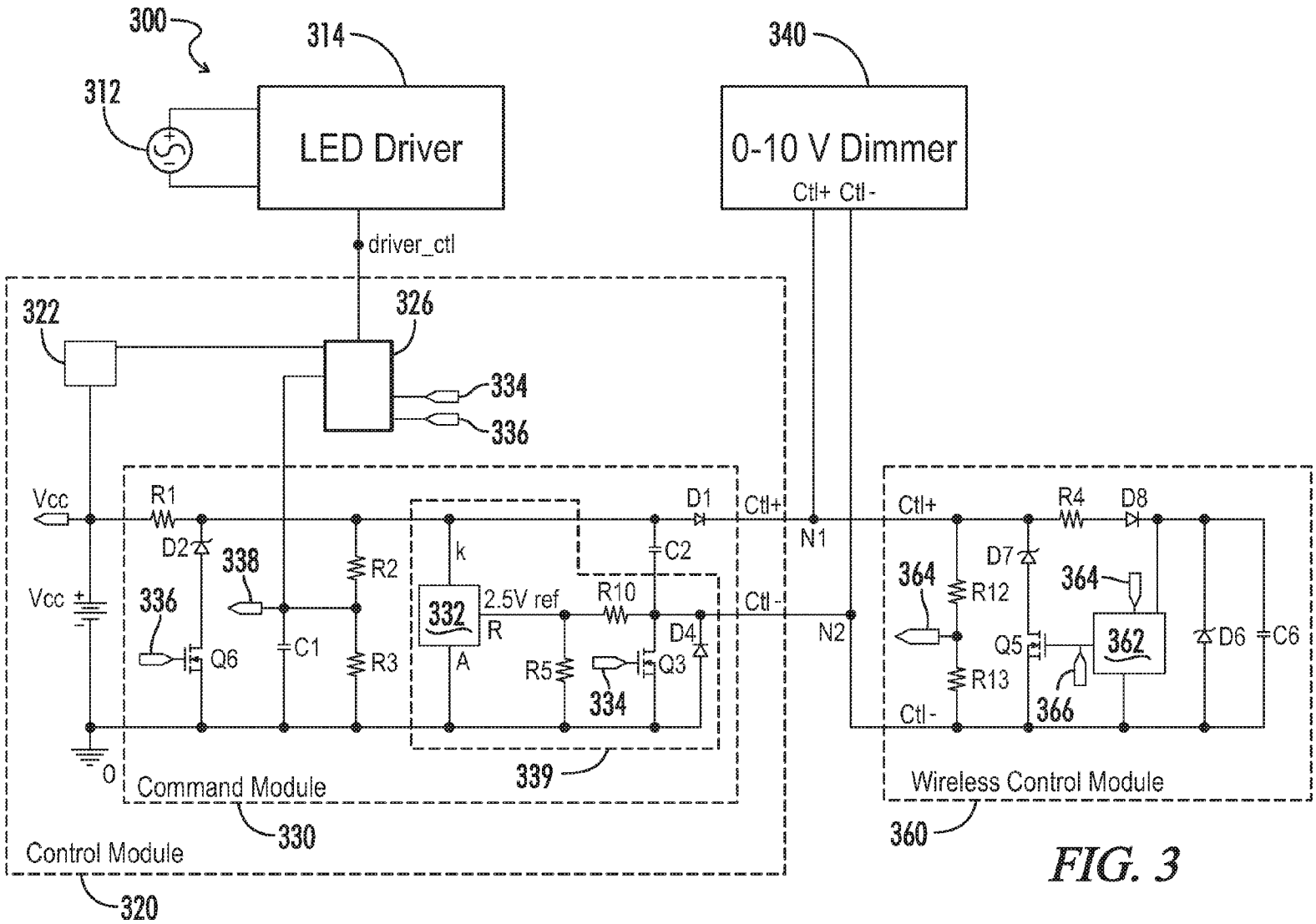
FIG. 3 illustrates a block diagram and partial schematic diagram of a control module having a combined control interface according to an exemplary embodiment the present invention.

FIG. 3 illustrates an exemplary embodiment of a lighting system 300 including a control module 320 having a combined dimming and control interface. The control module 320 may include a command module 330. In one exemplary embodiment, the command module 330 may be a 0-10 volt dimming control circuit. The control module 320 may be configured to receive one or more signals from a lighting dimmer 340 and/or a wireless control module 360 via a single combined signal interface, to enable or disable a 0-10 volt dimming interface and/or wireless control module, and to provide power via to at least one of the lighting dimmer 340 and the wireless control module 360 via the single combined signal interface. In one exemplary embodiment, the lighting dimmer 340 may be a 0-10 volt lighting dimmer.

An LED driver 314 is coupled between the AC power source V_AC_in 312 (e.g., an AC mains input) and an LED lighting module 314. The command module 330 may include or otherwise connect to a plurality of output lines (e.g., two lines, as illustrated in FIG. 3, though not limited to two) configured to communicate signals via Ctl+ (also described with reference to purple or purple+) and via Ctl− (also described with reference to grey or grey−). The plurality of lines associated with control signals Ctl+ and Ctl− may be provided as one or more terminals provided by at least one of the LED driver 314, the lighting dimmer 340, and/or wireless control module 360, either alone or in combination. In one exemplary embodiment, the plurality of lines includes a plurality of connectors. Alternatively or additionally, the plurality of lines may take the form of conductive lines, such as wires or other conductive material, configured to communicate one or more signals.

The command module 330 interfaces with at least one of the lighting dimmer 340 and/or the wireless control module 360. The wireless control module 360 shares the same control input lines with a lighting dimmer 340 at nodes N1 and N2. For example, in the embodiment illustrated by FIG. 3, the control line associated with the Ctl+ signal connected to the output of the lighting dimmer 340 is connected to the control line associated with the Ctl+ signal associated with the output of the wireless control module 360 at a node N1. The control line associated with the Ctl− signal connected to the output of the lighting dimmer 340 is connected to the control line associated with the Ctl− signal connected to the output of the wireless control module 360 at a node N2. Although illustrated in FIG. 3 as being positioned outside of the communications circuit 320, lighting dimmer 340, and wireless control module 360, one or more of the nodes N1 and N2 may be located at least partially within one or more of the control module 320, lighting dimmer 340, and/or wireless control module 360.

A microcontroller 326 is used to process digital and analog signals fed back from the lighting dimmer 340 and/or wireless control module 360. Microcontroller 326 transmits a control signal, driver_ctl to the LED driver 314. In some embodiments, the LED driver 314 may be a controllable LED driver capable of providing controllable output current regulation. The control signal driver_ctl is used by the LED driver 314 to create, modify, or otherwise manipulate at least one characteristic of output current regulation of the LED driver 314. In one exemplary embodiment, the LED driver 314 may be implemented as an adjustable AC-DC power converter. In one exemplary embodiment, the control signal driver_ctl may be transmitted via a command interface configured to communicatively couple the control module 320 and the LED driver 314. The terms "power converter" and "converter" unless otherwise defined with respect to a particular element may be used interchangeably herein and with reference to at least DC-DC, DC-AC, AC-DC, buck, buck-boost, boost, half-bridge, full-bridge, H-bridge or various other forms of power conversion or inversion as known to one of skill in the art. Although described with reference to an AC power input and an AC-DC converter, it should be appreciated that power input may additionally or alternatively be provided using DC power without departing from the spirit and the scope of the present invention.

A voltage regulator 322 (e.g., a 5 volt regulator) provides power to microcontroller 326. Voltage source Vcc may operate as a power supply for the 0-10 volt dimming interface. Resistor R1 is a current limiting resistor that limits the current going into the command module 330. During operation, a microcontroller transmit signal 336 may be output from the microcontroller 326 and coupled to a gate of the switch Q6. The microcontroller transmit signal 336 may be configured to cause the combination of the switch Q6 and diode D2 to modify a Ctl+ signal transmitted across the combined signal interface from the control module 320 to the wireless control module 360 by selectively controlling operation of the switch Q6.

The microcontroller 326 performs at least one of: (i) sensing at least one of the lighting dimmer 340 and wireless control module 360 connected to at least one common signal line; (ii) enabling or disabling a 0-10 volt dimming control circuit of the control module 320; (iii) decoding a dimming control signal 338 (e.g., an LED control signal) that is provided via at least one of Ctl+ and Ctl− signals from the lighting dimmer 340 and/or the wireless control module 360, and (iv) providing a control signal driver_ctl to the LED driver 314 to cause the LED driver 314 to dynamically change an output current and/or output voltage. The controller 326 is configured or programmed to cause a sensed LED current to be proportional to the sensed dimming control signal 338.

The terms "controller," "microcontroller", "control circuit" and "control circuitry" as used herein may refer to, be embodied by or otherwise included within a machine, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed and programmed to perform or cause the performance of the functions described herein. A general purpose processor can be a microprocessor, but in the alternative, the processor can be a controller, microcontroller, or state machine, combinations of the same, or the like. A processor can also be implemented as a combination of computing devices, e.g., a combination of a DSP and a microprocessor, a plurality of microprocessors, one or more microprocessors in conjunction with a DSP core, or any other such configuration.

In one exemplary embodiment, a 0-10 volt dimmer (e.g., a 0-10 volt dimmer operating as a DC voltage source) is connected between first and second signal lines (e.g., at nodes N1 and N2, as illustrated by FIG. 3), respectively, for dimming and control. An output current and/or voltage of the LED driver 314 may be manipulated by adjusting an output current or voltage setting of the LED driver 314 based at least in part upon a driver_ctl control signal transmitted to the LED driver 314 from the microcontroller 326. In one exemplary embodiment, the driver_ctl signal is based at least in part upon a dimming control signal 338 (e.g., an LED control signal) received at the command module 330 via the dimming signal lines as previously described.

Figure 4:
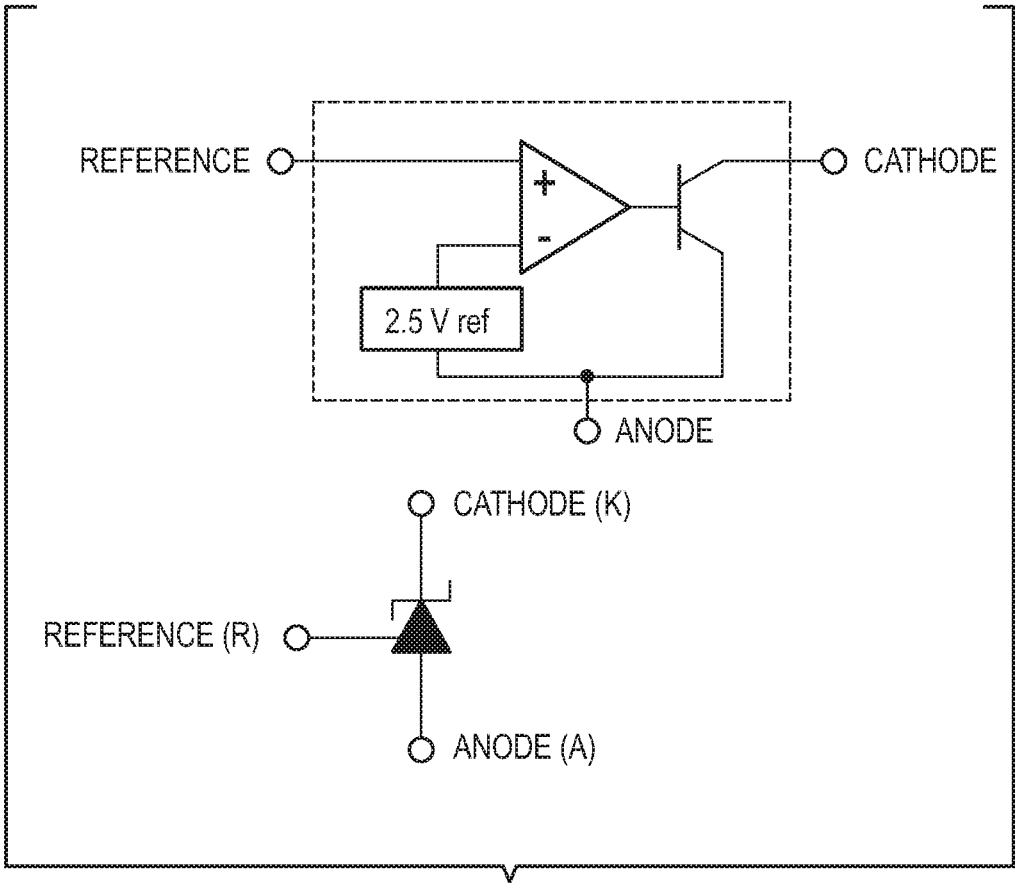
FIG. 4 is a block diagram illustrating exemplary internal circuit design for a voltage regulator of a dimming controller according to an exemplary embodiment of the present invention.

A voltage regulation device (such as a TL431) may be used as a dimming controller 332 in one embodiment. An exemplary internal block diagram for the TL431 regulator is represented in FIG. 4. The "A" terminal is the ground reference, while "k" is the input of the regulator and "R" is the reference voltage. In one exemplary embodiment, a resistor R5 may be coupled between terminals R and A of the voltage regulation device 332 to set the maximum output current allowed through the combined signal interface (e.g., associated with at least one of Ctl+ and Ctl−). In this example, the maximum current may be defined by 2.5V/R5. The dimming controller 332 of the exemplary embodiment illustrated by FIG. 3 regulates a maximum output source current for a combined signal interface when a lighting dimmer is connected. Diode D1 controls the current flow direction. Capacitor C2 may be a filter capacitor. Resistor R5 is a reference current setting resistor. Resistor R10 is a current limiting resistor in the exemplary embodiment illustrated by FIG. 3.

Resistors R2 and R3 form a voltage sensing circuit to sense a voltage across terminal k and A or voltage regulator 332. Capacitor C1 is a high frequency filter capacitor. A voltage across resistor R3 (also referred to as dim_sense) is fed back to the microcontroller 326 for processing. Switch Q3 (e.g., a MOSFET or BJT) permits disabling the voltage regulator 332 and disables the lighting dimmer 340 while sensing or otherwise enabling the wireless control module 360. A diode D4 is a protection diode for the switch Q3.

The wireless control module 360 may include a wireless module 362 (e.g., a wireless processor) configured to receive power via the combined signal interface from the control module 320 and to digitally communicate with the microcontroller 326 via the control module 320 via at least one shared signal line. The wireless control module 360 may include resistors R12 and R13 forming a voltage sensing circuit. A voltage across resistor R13, RXD_WLE, may be fed back to a wireless module 362 for processing associated with at least one received signal. A diode D7 and a switch Q5 may form a transmitting circuit capable of being controlled by a TXD_WLE signal, such that the wireless module 362 can communicate with the microcontroller 326 via the command module 330 of the control module 320.

In one exemplary embodiment, the diode D7 charges a power supply capacitor C6 of wireless control module 360 during operation. The diode D6 illustrated by FIG. 3 is a Zener diode that limits the maximum voltage across capacitor C6 in one exemplary embodiment. The wireless control module 360 may further include a resistor R4 configured as a current limiting resistor for charging the capacitor C6. A diode D8 may be coupled between the resistor R4 and the wireless module 362, diode D6, and capacitor C6 of the wireless control module 360. In one exemplary embodiment, the wireless control module 360 includes a communication signaling circuit configured to communicatively couple the wireless control module 360 to a dimming control circuit via a dimming control interface. The communication signaling circuit may include one or more components of the wireless control module 360 as illustrated by FIG. 3, and may be configured to transmit and receive signals via Ctl+ and Ctl−. For example, in the embodiment illustrated by FIG. 3, the communication signaling circuit may include the voltage detector formed by the resistors R12 and R13. Additionally or alternatively, the communication signaling circuit may include at least one of the resistors R12 and R13, the diode D7, the resistor R4, the diode D8, the diode D6, the capacitor C6, and the wireless module 362. In one or more embodiments, the communication signaling circuit may take the form of an independent communication circuit (not illustrated) which is connected to the wireless control module 360 but does not possess any of the components of the wireless control module 360.

In FIG. 3, a voltage regulator 332, (e.g., a TL431 voltage regulator, 5V voltage regulator, etc.), may be used to control a maximum source current for the combined signal interface when a lighting dimmer 340 is connected to and sensed by the control module 320 (e.g., in the manner described below). When the microcontroller 326 senses that a lighting dimmer 340 is connected to the control module 320, it may enable the voltage regulator 332 by disabling the switch Q3 (e.g., by setting G_WLE to 0). An exemplary internal structure of a voltage regulator 332 is shown in FIG. 4. The resistor R5 in FIG. 3 may be used to decouple the ground from Ctl− (which may be communicated via a Grey− wire in various embodiments). At point R of the voltage regulator 332, the voltage is always 2.5V in one exemplary embodiment. The input current of R to the voltage regulator 332 may be extremely small and/or neglected in one embodiment. As a result, a maximum current that can be allowed to go through lighting dimmer 340 may be defined as: 2.5V/R5 (e.g., 250 uA in one or more embodiments)

The resistors R2 and R3 form a voltage divider to sense the dimming signal controlled by the lighting dimmer 340. A voltage regulator 322 (e.g., a 5 volt regulator) may be used to supply the controller 326 with voltage from power source Vcc. Capacitor C2 is coupled across the Ctl+ and Ctl− signal lines to filter out high frequency noise. Diode D1 is provided along the positive signal line in one exemplary embodiment to force the direction of the current and block the negative voltage across the dimming interface input terminals. Resistor R1 may be provided to limit the current going into the voltage regulator 332. Resistor R10 may be used to decouple the circuit ground from the negative dimming interface signal Ctl−.

Resistors R2 and R3 may form a voltage divider to sense the dimming signal control 338 that is controlled by the voltage across Ctl+ and Ctl− (e.g., V_dimmer). The voltage across the resistors R2 and R3 is defined by:

$$V_R2_R3=0.7V+2.5V*(1+R10/R5)+V_\text{dimmer}$$

The dimming control signal 338 voltage (V_dim_sense) may thus be determined as follows:

$$V_dim_\text{sense}=(0.7V+2.5V*(1+R10/R5)+V_\text{dimmer})*R3/(R2+R3)$$

As a result, dimming control signal 338 voltage is linearly proportional to the dimming control voltage V_dimmer (e.g., a voltage output from the lighting dimmer 340 across nodes N1 and N2 via Ctl+ and Ctl− from the lighting volt dimmer 340). The microcontroller 326 senses the dimming control signal 338 and regulates or adjust the LED current and/or voltage output dynamically by modifying control signal driver_ctl. When the microcontroller 326 powers up, it may initially disable the voltage regulator 332 and/or lighting dimmer 340 to sense whether a wireless control module 360 is connected to the shared dimming interface.

As shown in FIG. 3, the microcontroller 326 may set a value of G_WLE to high (e.g., '1') when powering up and turn on the switch Q3. When the switch Q3 is conducting, Ctl− is effectively connected to ground (0). When this occurs, the voltage regulator 332 will no longer control the output current, since the output current can bypass the resistors R10 and R5 and go back to Vcc directly from ground (0).

In one exemplary embodiment, the control module 320 may include a dimming input control circuit 339. The dimming input control circuit 339 in one exemplary embodiment includes voltage regulator 332, resistors R5 and R10, switch Q3, and diode D4. The dimming input control circuit 339 may be configured to operate responsive to one or more dimming control signals received from the lighting dimmer 340 via the combined signal interface.

Figure 5:
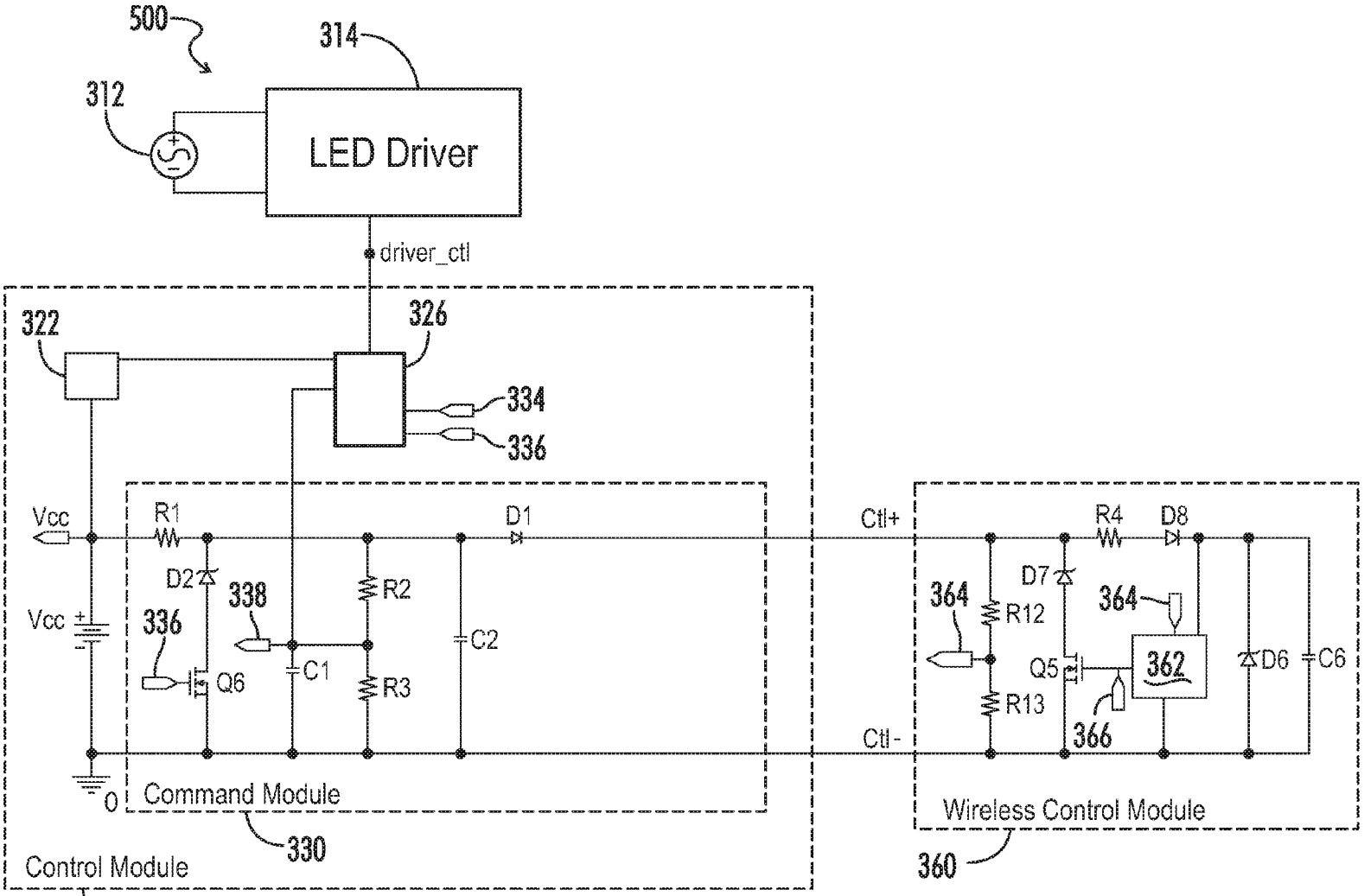
FIG. 5 illustrates a block diagram and partial schematic diagram of a simplified circuit view of FIG. 3 where the voltage regulator of the dimming controller is disabled according to an exemplary embodiment the present invention.

An equivalent circuit for one exemplary embodiment of the lighting system of FIG. 3 is shown by FIG. 5. FIG. 5 illustrates an exemplary embodiment of a simplified circuit 500 where the voltage regulator 332 (and thus dimming input control circuit 339) of FIG. 3 is disabled. In one exemplary embodiment, disabling the voltage regulator 332 may result in functionally bypassing one or more components of the dimming input control circuit 339. By disabling one or more components of the 0-10 volt dimming interface (e.g., the dimming input control circuit 339), operation of the command module 330 is greatly simplified. At initial power-up, the microcontroller 326 may disable the voltage regulator 332. As shown in FIG. 5, Vcc may then directly drive the wireless control module 360. In this exemplary embodiment, the maximum current is limited only by the resistor R1. Microcontroller 326 may send a testing signal by pulsing microcontroller transmit signal 336 so that the Ctl+ signal (e.g., at a purple+ wire) will be pulled down and up according to a testing protocol. Diode D2 may be a Zener diode. Diode D2 may have a clamping voltage designed to be greater than the minimum working voltage of wireless module 362, such that even when switch Q6 is conducting, the voltage between control lines carrying signals Ctl+ and Ctl− (e.g., across purple+ and grey− wires) will be greater than the minimum working voltage level of wireless module 362. Diode D7 and switch Q5 may be implemented the same manner as diode D2 and switch Q6.

Wireless control module 360 may be connected to the combined signal interface via the shared control lines and may sense the testing signal being sent out by the microcontroller 326 by reading a voltage at received signal 364 (e.g., RXD_WLE). If wireless module 362 receives the testing signal it may send a confirmation signal back to microcontroller 326 by pulsing transmitted signal 366 (e.g., TXD_WLE) using switch Q5. When the transmitted signal 366 is pulsing, switch Q5 may be triggered on and off based upon the transmitted signal 366 output from wireless module 362. As a result, the voltage across Ctl+ and Ctl− (e.g., at the purple+ and grey− wires) may be pulled down and up according to the confirming signal (i.e., transmitted signal 366).

Microcontroller 326 senses the transmitted signal 366 by reading the dimming control signal 338 to determine whether a wireless control module 360 is connected. If microcontroller 326 receives a valid confirming signal from wireless control module 360, in one exemplary embodiment microcontroller 326 maintains a G_WLE signal 334 value high (i) to enable wireless control, and (ii) to disable the combined signal interface. If microcontroller 326 does not receive a valid confirming signal responsive to the testing signal within a certain time (e.g., after a predetermined length of time) microcontroller 326 may disable the G_WLE signal 334 (e.g., by setting its value to low or '0') and enable lighting dimmer 340 so that lighting dimmer 340 may operate and be supported by command module 330 for at least a predetermined amount of time or until a reset or power-on occurs.

Figure 6A:
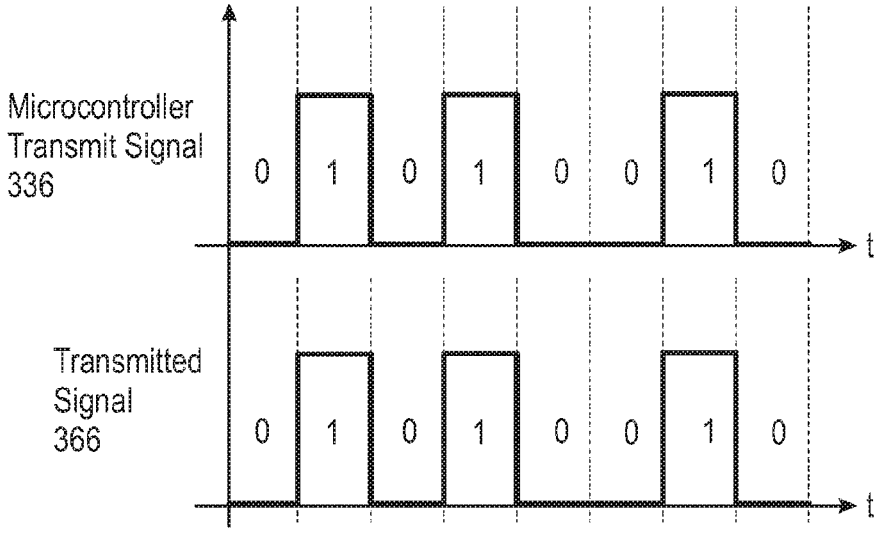
FIGS. 6A-C illustrate signal logical values and voltage levels corresponding to communications between a microcontroller and a wireless control module according to an exemplary embodiment of the present invention.
Figure 6B:
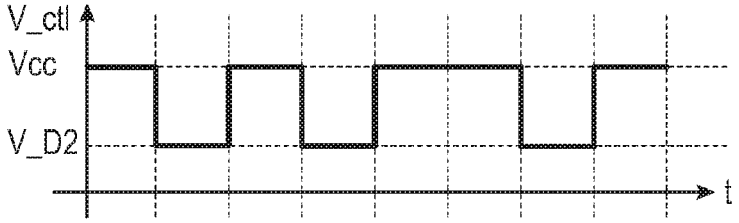
Figure 6C:
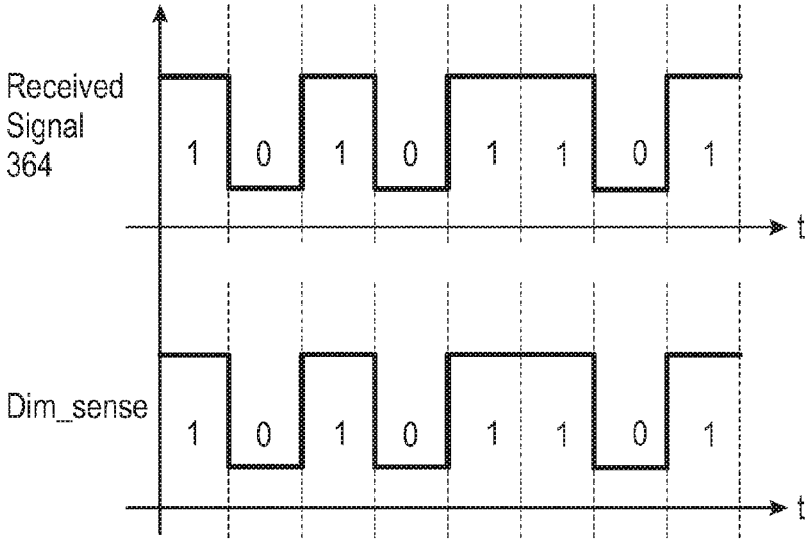

FIGS. 6A-C illustrate signal logical values and voltage levels corresponding to communications between the microcontroller 326 and a wireless control module 360 according to an exemplary embodiment. Signal patterns consistent with the present invention may be specifically designed in one or more embodiments to meet one or more communication requirements. The scaling of time t represented in FIGS. 6A-C may or may not reflect particular time correspondence between one or more of FIGS. 6A-C or between particular timing diagrams within each figure.

FIG. 6A illustrates a relationship between the microcontroller transmit signal 336 and the transmitted signal 366. As previously described, the transmitted signal 366 may be output from the wireless module 362 responsive to the microcontroller transmit signal 336 to cause the switch Q5 to turn on or off. In various embodiments, the transmitted signal 366 is provided to the communications circuit 320 and may be used, at least in part, for one or more of: (i) providing a confirming signal to the microcontroller 326 from the wireless control module 360 and/or (ii) providing at least one control signal from the wireless control module 360 to the microcontroller 326 via the control module 320.

As illustrated in FIG. 6B, a minimum voltage V_ctl across control lines carrying signals Ctl+ and Ctl− (e.g., via purple+ and grey− wires) may be clamped at a voltage V_D2 across diode D2 (which may be the same as V_D7, as previously described). The voltage V_D2 may be greater than the minimum working voltage of wireless module 362 in one exemplary embodiment. Thus, even when communication is ongoing, sufficient voltage supply may be provided for and to the wireless module 362 to ensure a stable working voltage across the capacitor C6.

FIG. 6C illustrates a relationship between the dim_sense signal and the received signal 364. As previously described, the received signal 364 may be received at the wireless module 362 from the microcontroller 326 (e.g., during a wireless control module 360 sensing process). In various embodiments, the received signal 364 may be used, at least in part for one or more of: (i) sensing the presence of a wireless control module 360 by the microcontroller 326, (ii) causing the wireless control module 360 to provide a confirming signal to the microcontroller 326 via the control module 320, and/or (iii) permitting at least one control signal to be transmitted from the wireless control module 360 to the microcontroller 326 via the control module 320 when the wireless control module 360 is sensed and when the lighting dimmer 340 is disabled.

Figure 7:
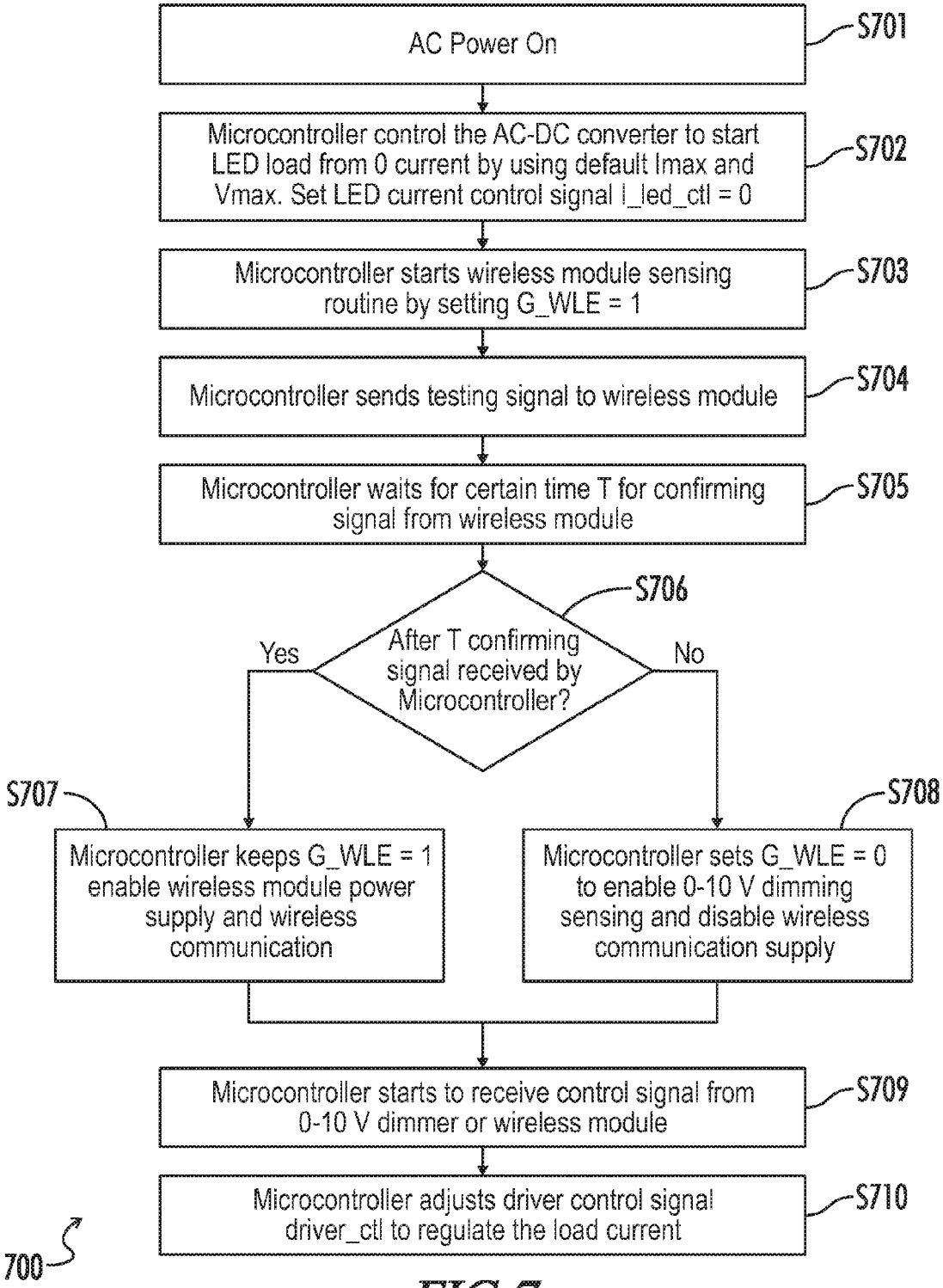
FIG. 7 illustrates a flowchart of a detailed microcontroller control sequence according to an exemplary embodiment of the present invention.

An exemplary embodiment of a detailed microcontroller control sequence 700 is illustrated by FIG. 7. The control sequence 700 begins at a step S701, where an alternating current (AC) power source provided (e.g., powered on). The process continues to step S702, where a microcontroller operates to cause the AC-DC converter to initiate an LED load current from zero using a default maximum current setting and a default maximum voltage setting. At step S703, the microcontroller initiates a wireless module sensing routine, for example by setting a G_WLE value to T. After initiating the wireless module sensing routing, the microcontroller sends a testing signal to the wireless module at the step S704. After sending the testing signal, the microcontroller operates at a step S705 to wait for a certain time T for a confirming signal to be received from the wireless module.

At step S706 it is determined whether a confirming signal was received by the microcontroller. If a confirming signal has been received, the process continues to step S707, where the microcontroller maintains the G_WLE value of '1' to enable powering the wireless control module and to permit wireless communication by the wireless control module. If it is determined at step S706 that a confirming signal was not received by the microcontroller, the process continues to step S708, where the microcontroller sets the G_WLE value to '0' to enable lighting dimming sensing (e.g., 0-10 volt dimming control sensing) and to disable supply of power to the wireless control module.

After performing either step S707 or S708, the control sequence 700 continues to step S709, where the microcontroller operates to receive at least one control signal from the lighting dimmer or from the wireless module. The control sequence then proceeds to a step S710, where the microcontroller operates to adjust a driver control signal driver_ctl to regulate a load current (e.g., the LED load current).

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims. The phrase "in one embodiment," as used herein does not necessarily refer to the same embodiment, although it may.

The term "circuit" means at least either a single component or a multiplicity of components, either active and/or passive, that are coupled together to provide a desired function. Terms such as "wire," "wiring," "line," "signal," "conductor," and "bus" may be used to refer to any known structure, construction, arrangement, technique, method and/or process for physically transferring a signal from one point in a circuit to another. Also, unless indicated otherwise from the context of its use herein, the terms "known," "fixed," "given," "certain" and "predetermined" generally refer to a value, quantity, parameter, constraint, condition, state, process, procedure, method, practice, or combination thereof that is, in theory, variable, but is typically set in advance and not varied thereafter when in use.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The previous detailed description has been provided for the purposes of illustration and description. Thus, although there have been described particular embodiments of a new and useful invention, it is not intended that such references be construed as limitations upon the scope of this invention except as set forth in the following claims.

What is claimed is:

1. A control system for a light emitting diode (LED) driver, wherein the LED driver is configured to provide power to an LED lighting module in an LED lighting system that includes a lighting dimmer and a wireless control module, the control system comprising:

a control module, the control module including, a microcontroller configured to receive at least one LED control signal and to determine an LED driver command signal; and a command module, the command module coupled to the microcontroller, the command module configured to communicate with both of the lighting dimmer and the wireless control module;

a command interface, the command interface configured to communicatively couple the control module and the LED driver; and a combined signal interface, the combined signal interface being configured to communicatively couple the command module and at least one of the lighting dimmer and the wireless control module, the combined signal interface being further configured to couple the at least one LED control signal from at least one of the lighting dimmer and the wireless control module to the control module, wherein the at least one LED control signal includes at least one of a dimming control signal and a wireless control signal, and wherein the microcontroller is configured to receive the at least one LED control signal, to process the at least one LED control signal to determine the LED driver command signal, and to transmit the LED driver command signal to the LED driver via the command interface.

2. The control system of claim 1, wherein the microcontroller is configured to transmit a sensing signal via the combined signal interface.

3. The control system of claim 2, wherein the microcontroller is configured to sense a presence of the wireless control module when connected to the combined signal interface based at least in part upon a confirmation signal received at the combined signal interface, the confirmation signal being associated with the sensing signal.

4. The control system of claim 1, wherein the command module comprises a voltage regulator configured to regulate a maximum output source current relating to the combined signal interface.

5. The control system of claim 4, wherein the microcontroller is configured to disable the voltage regulator when it is determined by the microcontroller that the wireless control module is connected to the combined signal interface.

6. The control system of claim 4, wherein the microcontroller is configured to disable the voltage regulator for a predetermined time associated with the wireless control module.

7. The control system of claim 6, wherein the microcontroller is further configured to selectively enable the voltage regulator upon expiration of the predetermined time.

8. The control system of claim 6, wherein the microcontroller is configured to disable the voltage regulator for the predetermined time upon powering on.

9. A method of providing light emitting diode (LED) driver control by a control module of an LED lighting system, the LED lighting system including a dimming controller and a wireless control module, the method comprising:

providing a combined signal interface between the control module and at least one of the dimming controller and the wireless control module;

configuring the control module to selectively disable dimming control associated with the dimming controller;

transmitting a sensing signal from the control module via the combined signal interface;

determining whether a second controller is connected to the combined signal interface based upon whether a confirmation signal is received at the control module via the combined signal interface responsive to the sensing signal; and selectively providing power to the second controller from the control module via the combined signal interface when it is determined that the second controller is connected to the combined signal interface.

10. The method of claim 9, further comprising receiving at least one control signal at the control module from the second controller while disabling the dimming control associated with the dimming controller.

11. The method of claim 9, wherein the configuring the control module to selectively disable the dimming control associated with the dimming controller, the transmitting the sensing signal, and the determining whether the second controller is connected to the combined signal interface are performed when the control module is powered on.

12. The method of claim 9, wherein the dimming controller comprises a 0-10 volt dimming apparatus and the second controller comprises a wireless control apparatus.

13. The method of claim 9, wherein the second controller comprises a wireless processor, and wherein providing power to the second controller via the combined signal interface comprises providing at least a minimum operating voltage of the wireless processor to the second controller via the combined signal interface.

14. The method of claim 9, wherein the combined signal interface comprises a plurality of conductive lines configured to connect to each of the dimming controller and the second controller both individually and in combination.

15. A wireless control module for controlling output of a light emitting diode (LED) driver via a control module of an LED lighting system, the wireless control module comprising:

a communication module configured to communicatively couple the wireless control module to the control module via a combined signal interface;

a processor configured to receive an input signal from the control module via the combined signal interface and to transmit an output signal to the control module via the combined signal interface;

an input voltage detector connected to the processor and to the combined signal interface, the input voltage detector being configured to receive one or more signals via the combined signal interface; and a switch connected to the processor, the switch being configured to operate responsive to the processor to transmit an output signal via the combined signal interface based upon the one or more signals received by the input voltage detector.

16. The wireless control module of claim 15, wherein the wireless control module is configured to receive operating power via the combined signal interface and further wherein an operating voltage associated with the operating power is greater than a minimum operating voltage of the processor.

17. The wireless control module of claim 15, wherein the processor is configured to transmit a confirmation signal via the combined signal interface responsive to a received sensing signal, the sensing signal being received via the combined signal interface and being configured to be detected by the processor in conjunction with the input voltage detector.

18. The wireless control module of claim 17, wherein the processor is configured such that the confirmation signal is created by the processor by controlling the switch to generate the confirmation signal and to transmit the confirmation signal along the combined signal interface.

19. The wireless control module of claim 17, wherein the processor is configured to generate the confirmation signal and to cause the confirmation signal to be substantially similar to the received sensing signal.

20. The wireless control module of claim 15, wherein the wireless control module is powered during operation by power received via the combined signal interface.

* * * * *